US008146964B2

(12) United States Patent
Spurr

(10) Patent No.: US 8,146,964 B2
(45) Date of Patent: Apr. 3, 2012

(54) SUPPORT MECHANISM AND A LATCH MECHANISM

(75) Inventor: Nigel Spurr, Solihull (GB)

(73) Assignee: Body Systems USA, LLC, Troy, MI (US)

( * ) Notice: Subject to any disclaimer, the term of this patent is extended or adjusted under 35 U.S.C. 154(b) by 831 days.

(21) Appl. No.: 12/034,897

(22) Filed: Feb. 21, 2008

(65) Prior Publication Data

US 2008/0217928 A1 Sep. 11, 2008

(30) Foreign Application Priority Data

Feb. 23, 2007 (GB) ..... 0703599.1

(51) Int. Cl.
*E05C 3/06* (2006.01)

(52) U.S. Cl. ..... 292/201; 292/216; 292/DIG. 23

(58) Field of Classification Search ..... 292/201, 292/216, DIG. 23
See application file for complete search history.

(56) References Cited

U.S. PATENT DOCUMENTS

| | | | | |
|---|---|---|---|---|
| 5,918,917 | A | 7/1999 | Elton et al. | |
| 5,979,951 | A * | 11/1999 | Shimura | 292/216 |
| 5,984,384 | A * | 11/1999 | Hamaguchi et al. | 292/216 |
| 6,332,634 | B1 * | 12/2001 | Fukumoto et al. | 292/201 |
| 6,371,538 | B1 * | 4/2002 | Inoue | 292/216 |
| 6,382,686 | B1 * | 5/2002 | Ishigaki et al. | 292/201 |
| 6,386,599 | B1 * | 5/2002 | Chevalier | 292/201 |
| 6,422,615 | B1 | 7/2002 | Roos et al. | |
| 6,964,438 | B2 * | 11/2005 | Koike et al. | 292/201 |
| 7,441,815 | B2 * | 10/2008 | Umino | 292/216 |
| 7,540,541 | B2 * | 6/2009 | Yoneyama et al. | 292/216 |
| 7,770,946 | B2 * | 8/2010 | Kouzuma | 292/201 |

FOREIGN PATENT DOCUMENTS

EP 1710377 10/2006

OTHER PUBLICATIONS

United Kingdom Search Report dated May 4, 2007.
United Kingdom Search Report dated Mar. 27, 2008.

* cited by examiner

*Primary Examiner* — Kristina Fulton
(74) *Attorney, Agent, or Firm* — Cantor Colburn LLP

(57) ABSTRACT

A latch mechanism includes a latch bolt moveable between an open position, a first safety position and a closed position. The latch mechanism further includes a power closure system operable to move the latch bolt from the first safety position to the closed position. The power closure system has a transmission path including a drive lever rotatable about a drive lever axis and being engageable with a drive surface of a further transmission path component. The transmission path is operable to connect a power actuator to the latch bolt. The latch mechanism has a first position at which the latch bolt is in the first safety position, the drive lever axis is in a first drive lever axis position, and the drive lever is engaged with the drive surface of the further transmission path component, a second position at which the latch bolt is in the closed position, the drive lever axis is in the first drive lever axis position, and the drive lever is engaged with the drive surface of the further transmission path component, and a third position at which the latch bolt is in the open position, the drive lever axis is in a second drive lever axis position, and the drive lever is disengaged from the drive surface of the further transmission path component.

13 Claims, 18 Drawing Sheets

CLOSED

Latch Open

First Safety Position

Full Latch Position

Full Latch Position

Manual Release

SUPPORT MECHANISM AND A LATCH MECHANISM

REFERENCE TO RELATED APPLICATIONS

This application claims priority to United Kingdom Application No. GB 0703599.1 filed on Feb. 23, 2007.

BACKGROUND OF THE INVENTION

The present invention relates to a support mechanism, in particular to a support mechanism for use in a latch mechanism. Another aspect of the present invention relates to a latch mechanism.

Latch mechanisms are known to be provided on vehicle doors, such as cars (automobiles), which hold the door in a closed position, yet allow the door to be opened. The latch has a fully closed position at which the associated door is fully closed. The latch also has a first safety position at which the associated door is not quite fully closed, but nevertheless will not open. The latch has an open position at which the door can be opened to allow entry and exit of a vehicle driver or a passenger.

Certain latch mechanisms include power closure systems. In order for the power closure system to operate, the door is moved from the fully opened position to the first safety position, typically manually by the vehicle driver/passenger. Sensors within the latch detect when the door is in the first safety position, and a control system powers an actuator, typically an electric motor, to drive the latch bolt of the latch to the fully closed position. Further sensors detect when the latch bolt is in the fully closed position, following which the power closure mechanism is returned to its rest position.

In the event that a malfunction occurs part way through the power closing operation, there is a risk that the power closure system will jam. Under such circumstances, it is not possible to open the door. To address this problem, various complicated systems have been devised to ensure that the door can still be opened, even in the event of such a malfunction.

A further problem occurs when it is required to open the door part way through a power closing sequence. Under these circumstances, the power closure sequence must be complete and only then can the door be opened. This causes a delay, which can be frustrating to the person operating the latch.

SUMMARY OF THE INVENTION

Thus, according to the present invention, there is provided a latch mechanism including a latch bolt moveable between an open position, a first safety position and a closed position. The latch mechanism further includes a power closure system operable to move the latch bolt from the first safety position to the closed position. The power closure system has a transmission path including a drive lever rotatable about a drive lever axis and being engageable with a drive surface of a further transmission path component. The transmission path is operable to connect a power actuator to the latch bolt. The latch mechanism has a first position at which the latch bolt is in the first safety position, the drive lever axis is in a first drive lever axis position, and the drive lever is engaged with the drive surface of the further transmission path component, a second position at which the latch bolt is in the closed position, the drive lever axis is in the first drive lever axis position, and the drive lever is engaged with the drive surface of the further transmission path component, and a third position at which the latch bolt is in the open position, the drive lever axis is in a second drive lever axis position, and the drive lever is disengaged from the drive surface of the further transmission path component.

According to another aspect of the present invention, a support mechanism for supporting and releasing a load includes a chassis, a first link pivotally attached to the chassis about a first rotational axis, a second link pivotally attached to the first link about a second rotational axis, and a third link pivotally attached to the second link about a third rotational axis, the third link having a load application point remote from the third rotational axis. The first rotational axis and the second rotational axis define a first link axis, the second rotational axis and the third rotational axis define a second link axis, and the third rotational axis and the load application point define a third link axis. The support mechanism has a first support mechanism position for supporting a load applied at the load application point in a direction of the third link axis in which the first link axis and the second link axis are generally parallel and the first rotational axis and the third rotational axis are generally in line. The support mechanism has a second support mechanism position for releasing a load at which the third rotational axis is generally remote from the first rotational axis.

According to another aspect of the present invention, there is provided a support mechanism for supporting and releasing a load including a chassis, a first link pivotally attached to the chassis about a first rotational axis, a second link pivotally attached to the first link about a second rotational axis, and a third link pivotally attached to the second link about a third rotational axis, the third link having a load application point remote from the third rotational axis. The first rotational axis and the second rotational axis define axes defining a first link axis, the second and third rotational axes define a second link axis, and the third rotational axis and the load application point define a third link axis. The support mechanism has a first support mechanism position for supporting a load applied at the load application point in a direction of the third link axis in which the first link axis and the second link axis are generally parallel and the first rotational axis and the third rotational axis are generally in line. The support mechanism has a second support mechanism position for releasing a load at which the load application point is spaced differently from the first rotational axis than when the support mechanism is in the first position.

BRIEF DESCRIPTION OF THE DRAWINGS

The invention will now be described, by way of example only, with reference to the accompanying drawings in which.

DETAILED DESCRIPTION OF THE PREFERRED EMBODIMENT

Figure 1:
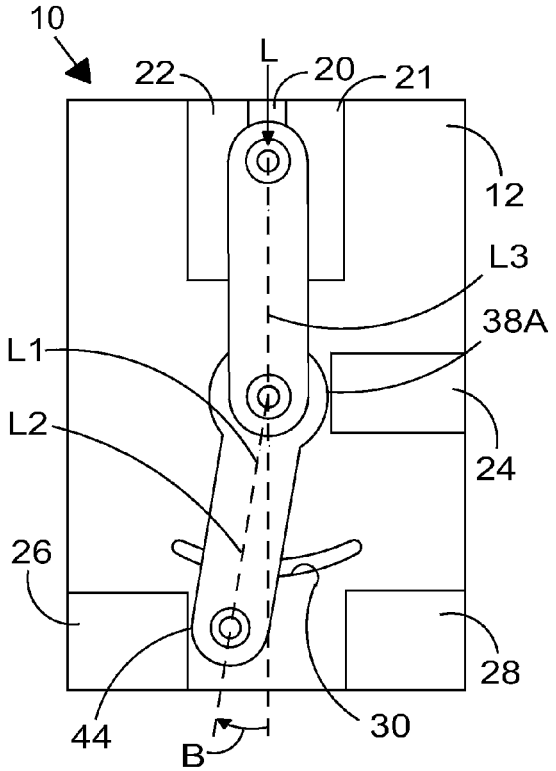
FIGS. 1 to 4 show a support mechanism for supporting and releasing a load according to the present invention.

FIGS. 1 to 4E show a support mechanism 10. The major components of the support mechanism are a chassis 12, a first link 14, a second link 16 and a third link 18.

The chassis 12 includes a guide path 20 defined between raised ribs 21 and 22. The chassis 12 also includes a first stop 24, a second stop 26 and a third stop 28. An arcuate slot 30 is also provided in the chassis 12.

The first link 14 is generally elongate and is pivotally mounted at a first pivot pin 32 to the chassis 12. The first pivot pin 32 defines a first rotational axis A1 about which the first link 14 can rotate to a limited extent (as will be described below) relative to the chassis 12.

Figure 4:
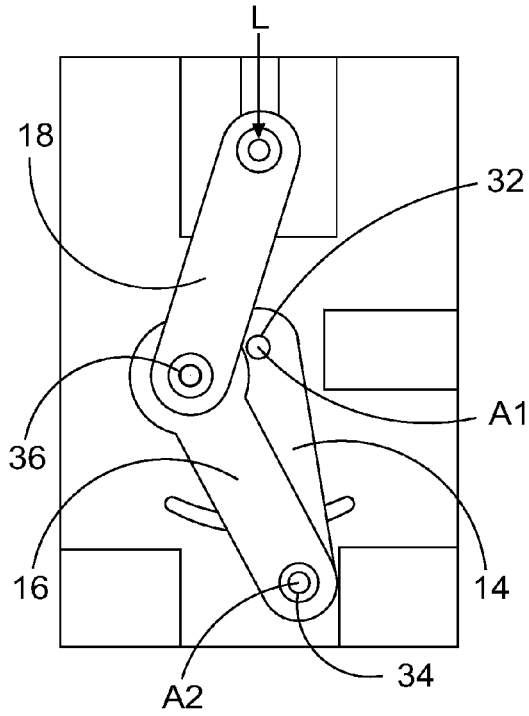

The first link 14 includes a pin 42 (best seen in FIG. 4B) that is attached to and projects from the first link 14. The pin 42 projects through the arcuate slot 30, and the end 42A is moved by an actuator, as will be described further below. A second pivot pin 34 is provided at an opposite end of the first link 14.

The second link 16 is generally elongate and is pivotally attached to the first link 14 via the second pivot pin 34. The second pivot 34 defines a second rotational axis A2 about which the second link 16 can rotate relative to the first link 14.

Figure 2:
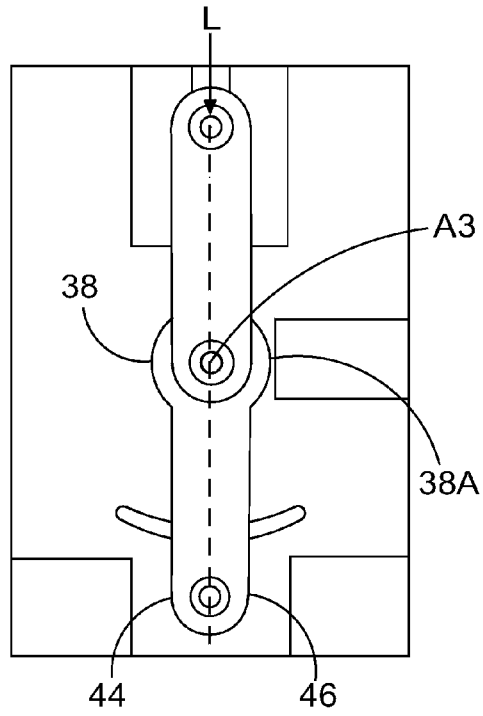
Figure 3:
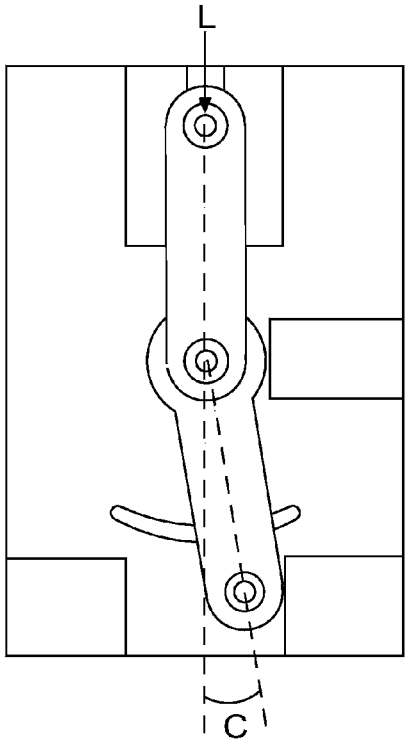

A third pivot pin 36 is provided at an upper end (when viewing FIG. 4) of the second link 16. The upper portion of the second link 16 is bulbous and has a circular periphery centered on the third pivot pin 36. An edge 38A of the circular periphery 38 engages the first stop 24 as shown in FIGS. 1, 2 and 3, as will be described in more detail below.

The third link 18 is generally elongate and is rotatably attached to the second link 16 via the third pivot pin 36. The third pivot pin 36 therefore defines a third rotational axis A3 about which the third link 18 can rotate relative to the second link 16.

Figure 4A:
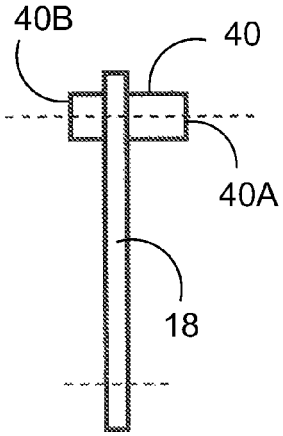
FIGS. 4A to 4E show various views of certain components of the support mechanism of FIG. 1.
Figure 4B:
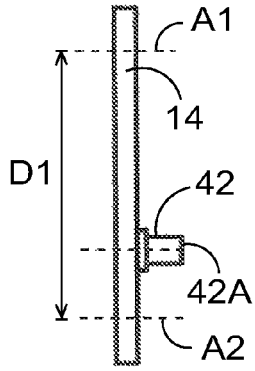

At the upper end (when viewing FIG. 2) of the third link 18, there is provided a pin 40, which projects on either side of the third link 18 (best seen in FIG. 4A). An end 40A defines a load application point, i.e., a load L is applied through the end 40A in the direction as shown in FIG. 1. The end 40B acts as a guide pin and moves along the guide path 20 (as will be described below) since it is positioned between the raised ribs 21 and 22.

Figure 4C:
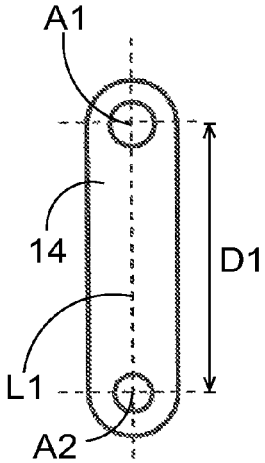

FIG. 4C shows the first link 14 in isolation, and it can be seen that the first rotational axis A1 and the second rotational axis A2 are separated by a distance D1. The first rotational axis A1 and the second rotational axis A2 together define a first link axis L1.

Figure 4D:
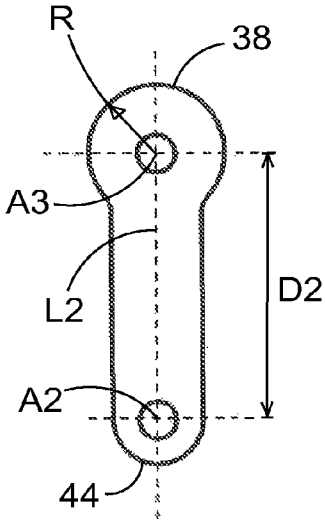

FIG. 4D shows the second link 16 in isolation. A distance D2 is defined between the second rotational axis A2 and the third rotational axis A3, which in this case is the same as the distance D1. The second rotational axis A2 and the third rotational axis A3 together define a second link axis L2.

Figure 4E:
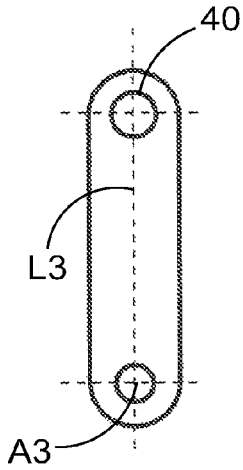

FIG. 4E shows the third link 18 in isolation. The end 40A of the pin 40 and the third rotational axis A3 together define a third link axis L3.

Operation of the support mechanism 10 is as follows. In summary, FIG. 1 shows the support mechanism 10 in a position where it is supporting the load L. By swinging the first link 14 in a counter-clockwise direction (when viewing FIGS. 1 to 4) about the first rotational axis A1 (by moving the end 42 in a counter-clockwise direction), the support mechanism 10 can be moved through the FIG. 2 and FIG. 3 positions to the FIG. 4 position where upon the support mechanism 10 can no longer support the load L, which is therefore released as the second link 16 and the third links 18 buckle (collapse).

In more detail, as shown in FIG. 1, a load L is applied to end 40A of the pin 40. The edge 38A of the second link 16 is engaged with the first stop 24. The lower left edge 44 of the second link 16 is engaged with the second stop 26. Because the distance D1 between the first rotational axis A1 and second rotational axis A2 (see FIG. 4C) is the same as the distance D2 between the second rotational axis A2 and a third rotational axis A3 (see FIG. 4D), and because the circular periphery 38 has a radius R equal to the distance between the first stop 24 and the first rotational axis A1, then the first rotational axis A1 and the third rotational axis A3 are in line, i.e., they are coincident. Note also that the first link axis L1 and second link axis L2 are parallel with each other.

Furthermore, it can be seen from FIG. 1 that the third link axis L3 is angled relative to the second link axis L2 (and the first link assist L1) by an angle B, in this case 10 degrees. There is thus a tendency for the second link 16 and the third link 18 to buckle (or collapse), but this is prevented because of engagement between the edge 38A of the second link 16 and the first stop 24. In order to release the load, a force is applied to the end 42A of the pin 42 in a direction that swings the first link 14 clockwise through the position shown in FIG. 2 to the position shown in FIG. 3, whereupon the lower right edge 46 of the second link 16 engages the third stop 28. It can be seen from FIG. 3 that the angle between the second link axis L1 and the third link axis L3 is now −10 degrees. Once the first link 14 has been moved to the position shown in FIG. 3, there is now nothing to stop the second link 16 and the third link 18 buckling (collapsing), and this is shown in FIG. 4. At this stage, this system can no longer support the load, which is therefore released.

A particular advantage of the support mechanism 10 is that a relatively low force is required to move the first link 14 from the FIG. 1 position to the FIG. 4 position. This is because the forces to be overcome are just the frictional forces associated with the first pivot pin 32 and the third pivot pin 36. It will be noted that when moving from the FIG. 1 position to the FIG. 3 position, no relative rotation has occurred between the first link 14 and the second link 16 and hence friction at the second pivot pin 34 does not effect the force required to move the first link 14 from the FIG. 1 position to the FIG. 3 position. Note also that when moving from the FIG. 1 position to the FIG. 3 position, the point at which the load is applied, i.e., the end 40A of the pin 40, has not moved.

The support mechanism 10 can be used to support various types of load. The latch mechanism shown in FIGS. 5 to 9 includes a support mechanism 10 according to the present invention.

With reference to FIGS. 5 to 9, there is shown a latch mechanism 108 having a latch chassis 112. The latch mechanism 108 also includes a latch bolt in the form of a rotatable claw 150, which is rotatably mounted on the latch chassis 112 by a pivot pin 152. The rotatable claw 150 can be moved between an open position shown in FIG. 5, a first safety position shown in FIG. 6 and a closed position shown in FIG. 7. The rotatable claw 150 includes a mouth 153 for receiving a latch striker (not shown), which will typically be mounted on the periphery of a door aperture, the latch typically being mounted on the door. The rotatable claw 150 also includes a first safety abutment 154 and a closed abutment 156.

Figure 5:
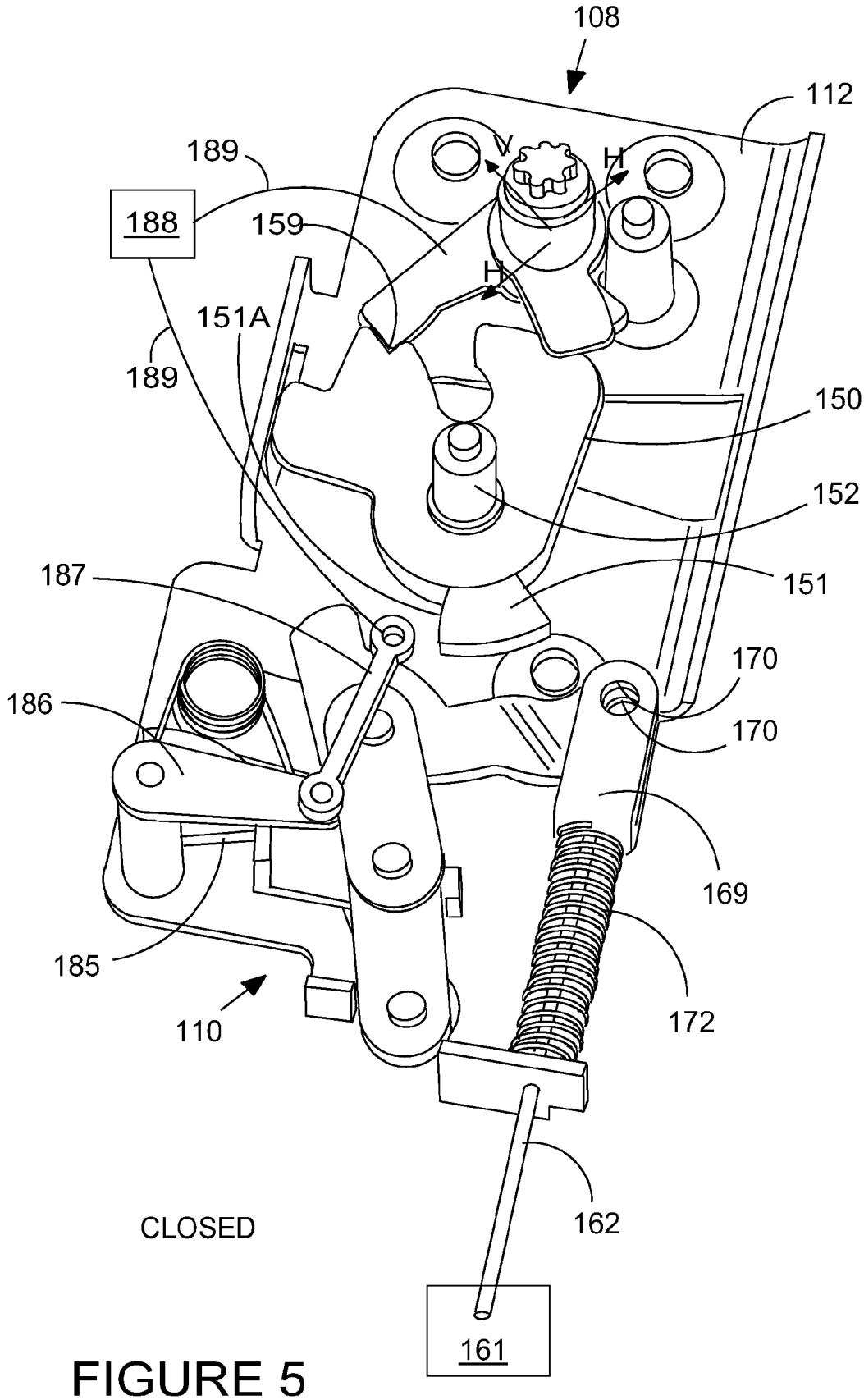
FIGS. 5 to 9 show various views of a latch mechanism according to the present invention.
Figure 6:
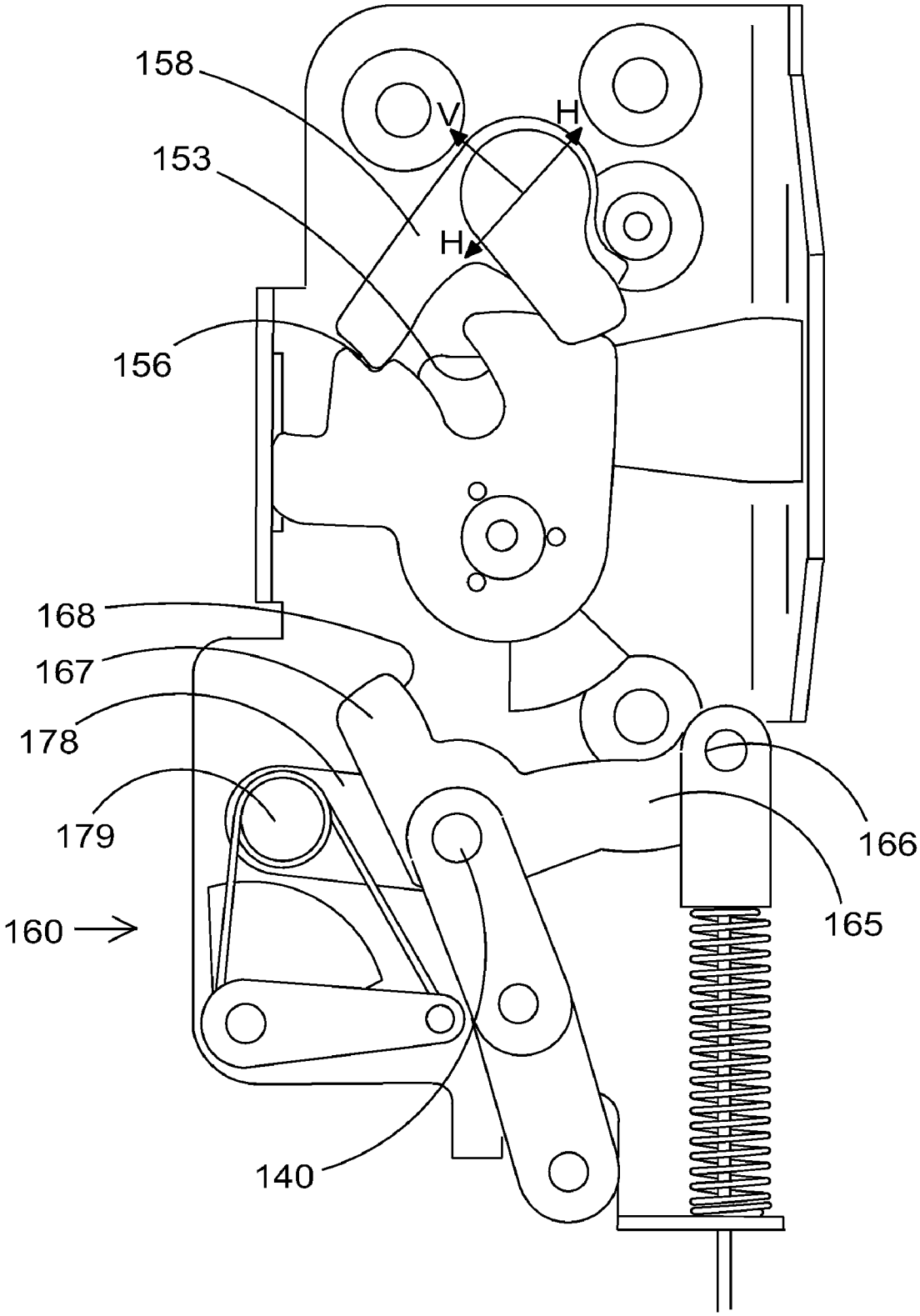
Figure 7:
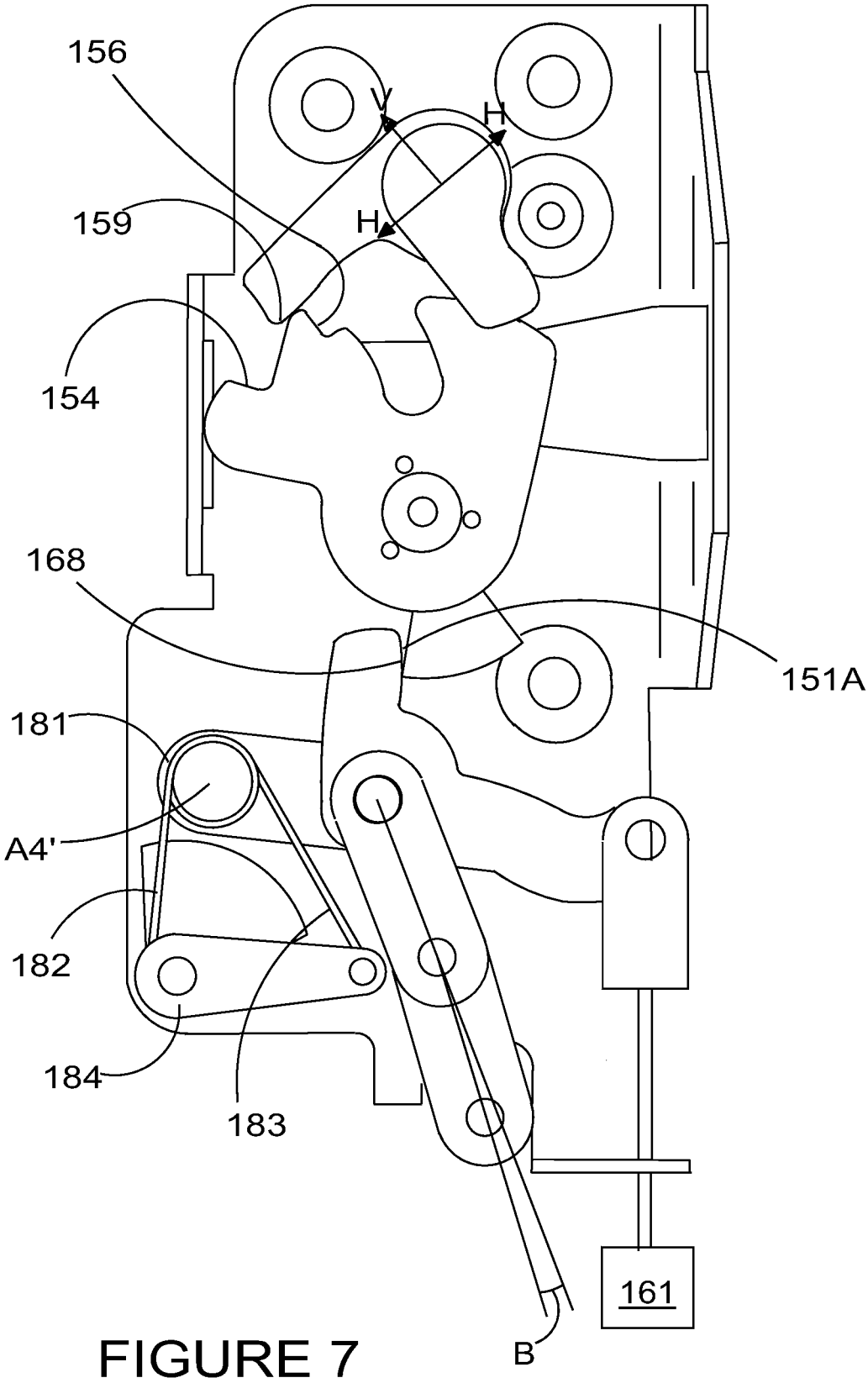

A pawl 158 is mounted on the latch chassis 112 and can be moved between an engaged position as shown in FIGS. 5 and 6 and a disengaged position as shown in FIG. 7. In the engaged position, a pawl tooth 159 can either engage the first safety abutment 154 to hold the latch in a first safety position or the pawl tooth 159 can engage the closed abutment 156 to hold the latch in a closed position (see FIGS. 5 and 6). The rotatable claw 150 also includes a power closure lug 151 having an abutment 151A.

The latch mechanism 108 also includes a power closure system 160. The major components of the power closure system 160 are a support mechanism 110, a power actuator 161, a cable 162 and a drive lever 164.

The major components of the support mechanism 110 are a first link 114, a second link 116 and a third link 118. The first link 114 is pivotally mounted on the latch chassis 112 via first pivot pin 132 (which defines a first rotational axis A1'). The second link 116 is pivotally attached to the first link 114 via second pivot pin 134 (which defines a second rotational axis A2'). The second link 116 is pivotally attached to the third link 118 by third pivot pin 136 (which defines a third rotational axis A3'). At an upper end of the third link 118, there is a pin 140 which acts to both apply a load to the third link 118 and also to guide the upper end of the third link 118, as will be described further below.

The first and second rotational axes A1' and A2' define a first link axis L1'. The second and third rotational axes A2' and A3' define a second link axis L2'. A load application point of the pin 140 and the third rotational axis A3' define a third link axis L3'. In this case, the load is applied through the axis A5' of the pin 140.

The drive lever 164 is rotationally attached to the upper end of the third link 118 via a pin 140. The drive lever 164 is generally L-shaped having a first arm 165, which includes a hole 166. The drive lever 164 also includes a second arm 167, which includes an abutment 168.

The power actuator 161 is shown schematically and is typically an electric motor. The power actuator 161 may also typically include a gear box system that drives an arm that can apply tension to the cable 162. Such power actuators are well known and will not be described further.

Figure 11:
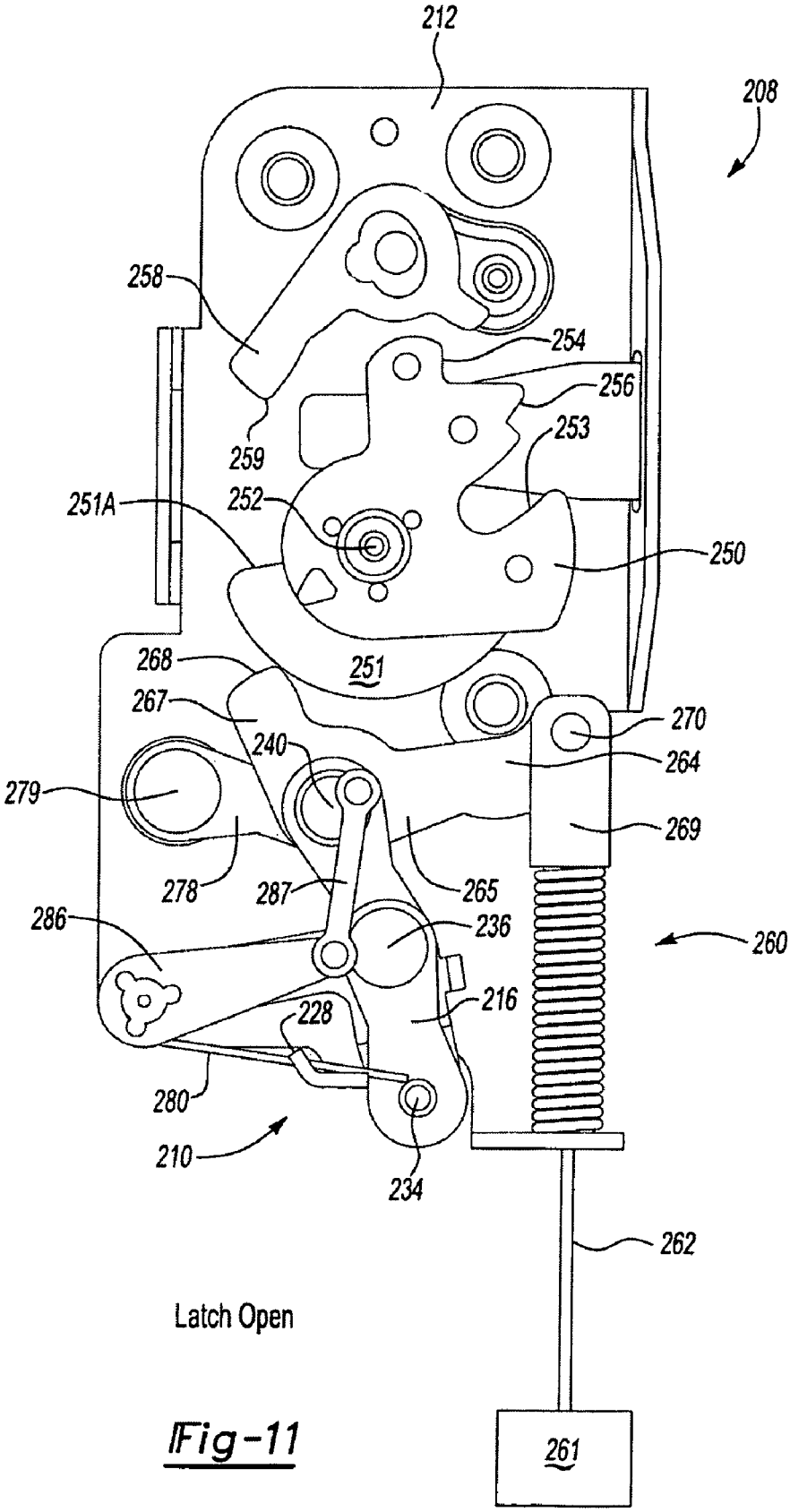
FIGS. 11 to 18A show various views of a further embodiment of a latch mechanism according to the present invention.

The cable 162 includes an end fitting 169 in the form of a U-shaped clip. Each arm of the U-shaped clip includes a hole 170, and a coupling pin 171 (only shown in FIG. 11) passes through the holes 170 and the hole 66 to couple the cable to the first arm 114 of the drive lever 164. The first abutment 168 selectively engages and drives the abutment 151A of the power closure lug 151, as will be further described below. A compression spring 172 acts to return the drive lever 164 to its rest position, as will be further described below.

Figure 10:
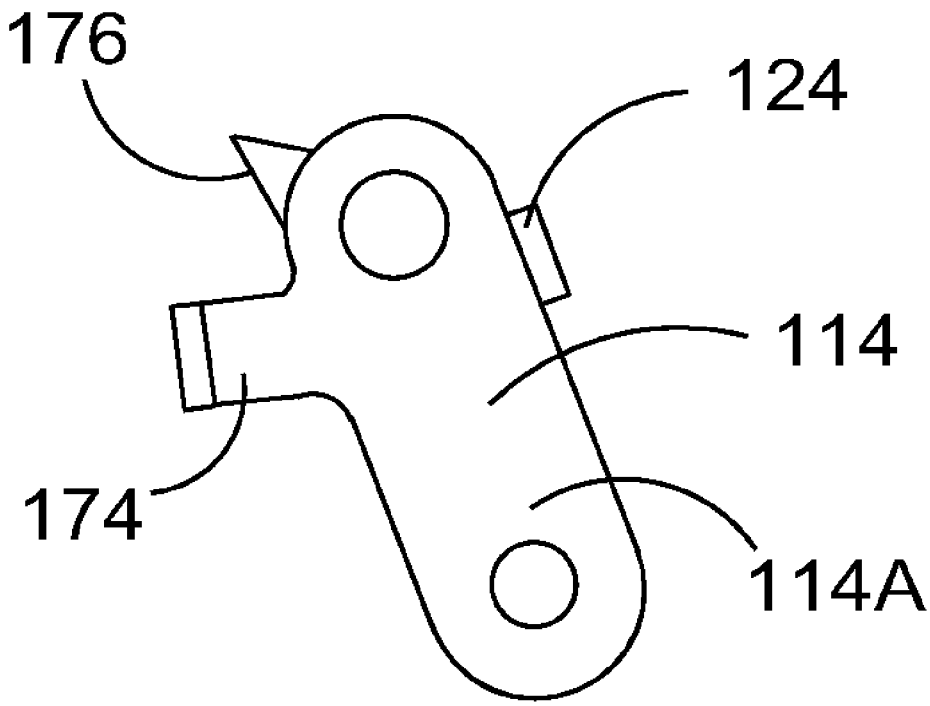
FIG. 10 shows a first link of the latch of FIG. 5 in isolation.

As mentioned above, the support mechanism 110 includes the first link 114, the second link 116 and the third link 118. Consideration of FIG. 10 shows that the first link 114 includes a first stop 124 which is bent up from the generally planar portion 114A of the first link 114. In use, the stop 124 is engaged by an edge 138 of the second link 116 to prevent the second link 116 rotating clockwise (about the second rotational axis A2') relative to the first link 114 past the position shown in FIG. 5. The first link 114 also includes an arm 174 and having an abutment 176.

A guide link 178 is generally elongate and is pivotally attached to the latch chassis 112 via a guide pivot pin 179 (which defines a fourth rotational axis A4'). An end of the guide link 178 remote from the guide pivot pin 179 includes a hole (not shown) through which the pin 140 passes to rotatably secure the guide link 178 to the drive lever 164. It will therefore be appreciated that the pin 140 allows the third link 118, the drive lever 164 and the guide link 178 to all rotate mutually relative to each other about the axis A5', the axis of the pin 140.

Because the guide link 178 is rotatably attached to the chassis 112 at the guide pivot pin 179, movement of the pin 140 must necessarily be arcuate movement about the axis A4' of the guide pivot pin 179.

A torsion spring 180 has a helically wound portion 181 (which is mounted on an extension of the guide pivot pin 179) and arms 182 and 183. The arm 182 reacts against an abutment of the latch chassis 112, and the arm 183 engages the abutment 176 of the first link 114 to bias the first link 114 in a clockwise direction when viewing FIG. 9.

A lever 184 is pivotally mounted on the latch chassis 112 and includes an abutment 185, which is engageable with the arm 174 of the first link 114. The lever 184 also includes an arm 186 connected to the link 187. The link 187 and the pawl 158 are both connected to a release handle 188 (shown schematically) via connections 189 (shown schematically).

The latch mechanism 108 has various operating modes as follows. Under normal operating conditions, assume the door is open and the latch mechanism 108 will therefore be in a position equivalent to the FIG. 11 position of the latch mechanism 208 (see below). The vehicle operator will close the door to the first safety position and hence cause the latch mechanism 108 to move to the first safety position (equivalent to the FIG. 12 position of the latch mechanism 208). Sensors detect when the latch mechanism 108 is in the first safety position and cause the power actuator 161 to be actuated, which tensions the cable 162 and causes the drive lever 164 to rotate clockwise such that the abutment 168 of the drive lever engages the abutment 151A of the power closure lug 151 (equivalent to the FIG. 13 position of the latch mechanism 208). Continued operation of the power actuator 161 causes the drive lever 164 to continue to rotate in a clockwise direction (see FIG. 7), resulting in the rotatable claw 150 rotating in a clockwise direction to the fully closed position (equivalent to the FIG. 15 position of latch mechanism 208). Sensors detect this fully closed position and power to the power actuator 161 is stopped. The drive lever 164 then returns to the FIGS. 5/6 position under the influence of the compression spring 172.

It will be appreciated that during the power closure operation, a load will have been applied to the third link 118 via the pin 140, tending to compress the third link 118. It would be appreciated that throughout the above mentioned power closure sequence, the load is supported by the support mechanism 110, and in particular the axis A5' of the pin 140 has not moved. Note the angle B' between the second link axis L2' and third link axis L3', in this case B', is 7 degrees.

However, consider the situation where, part way through the power closure operation, the power actuator 161 jams. Thus, starting at the first safety position, the power actuator 161 is actuated, and the drive lever 164 rotates the rotatable claw 150 part way towards the fully closed position. This position is shown in FIG. 7, and it will be appreciated that the pawl tooth 159 has been disengaged from the first safety abutment 154 but has not yet engaged the fully closed abutment 156. For the purposes of this example, it is assumed that the power actuator 161 jams when in the FIG. 7 position. It can be seen that abutment 168 has engaged the abutment 151A, and thus while the components remain in the FIG. 7 position, it is not possible to open the door. This problem is solved by moving the support mechanism 110 such that it can no longer support the load applied to it.

Thus, when in the FIG. 7 position, if the release handle 188 is operated, then this will move the pawl 158 to the disengaged position and will also rotate the lever 184 in a clockwise direction. This clockwise rotation of the lever 184 causes the abutment 185 of the lever 184 to engage the arm 174. The arm 174 is caused to move generally downwardly, which results in the first link 114 being rotated counter-clockwise about the first pivot axis A1' to the position shown in FIG. 8. When in this position, the second link 116 and the third link 118 can no longer support the load applied to the pin 140 by the drive lever 164 and hence they buckle (collapse) to the position shown in FIG. 9. Note that in the FIG. 7 position, the angle between the second link axis L2' and the third link axis L3' is B' (+7 degrees), whereas in the FIG. 8 position, the angle has changed to C' (−14 degrees). The collapsing of the second link 116 and the third link 118 allows the pin 140 to rotate in a clockwise direction about the axis A4' since the pin 140 will be guided by the guide link 178. Movement of the pin 140 about the axis A4' causes the abutment 168 to move generally downwardly, and hence disengage from the abutment 151A. Once the abutment 168 has disengaged from the abutment 151A, then the rotatable claw 150 is free to rotate in a clockwise direction allowing the door to be opened (since, as mentioned above, when the release handle 188 was operated, it rotated the lever 184 and also moved the pawl 158 to its disengaged position, thereby ensuring that the pawl tooth did not re-engage with the first safety abutment 154).

It is also advantageous to operate the support mechanism 110 during operation of the power closure system 160 even when the power closure system 160 operates correctly. Thus, consider the situation where the door has been closed to the first safety position. Sensors will cause the power closure system 160 to operate and move the latch mechanism 108 to the position shown in FIG. 7. For the purposes of explanation, assume that when the latch reaches the FIG. 7 position, the release handle 188 is operated while the power closure system 160 continues to function correctly. Under these circumstances, two events occur at the same time: a) the second link 116 and the third link 118 of the support mechanism 110 buckle (collapse) to the FIG. 11 position, thereby allowing the door to be opened, and at the same time, b) the power actuator 161 continues to pull the cable to its normal "fully closed" position, i.e., the power actuator 161 will move to its fully actuated position. Once this has occurred, the actuator will then allow the drive lever 164 to return to its normal rest position.

Figure 8:
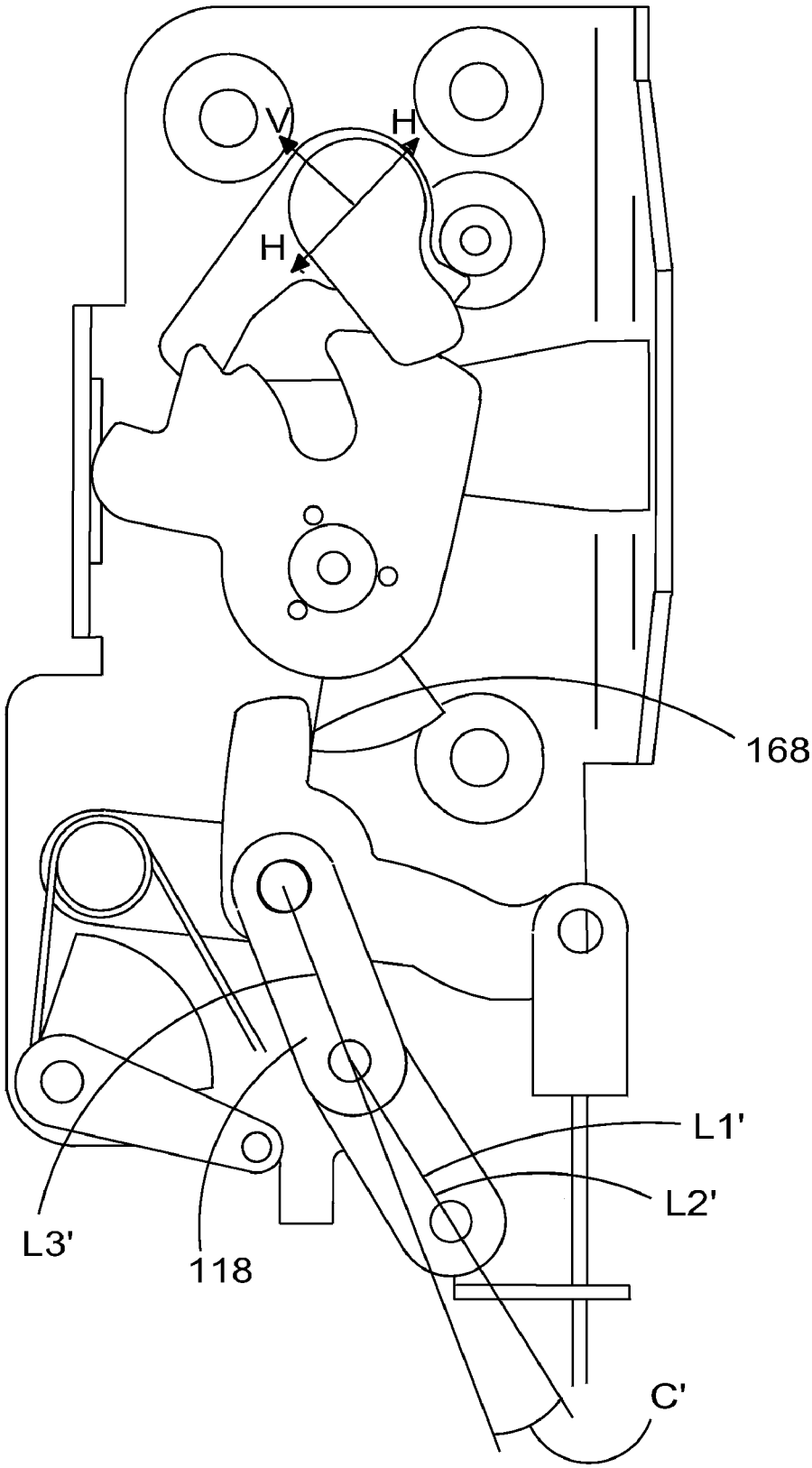
Figure 9:
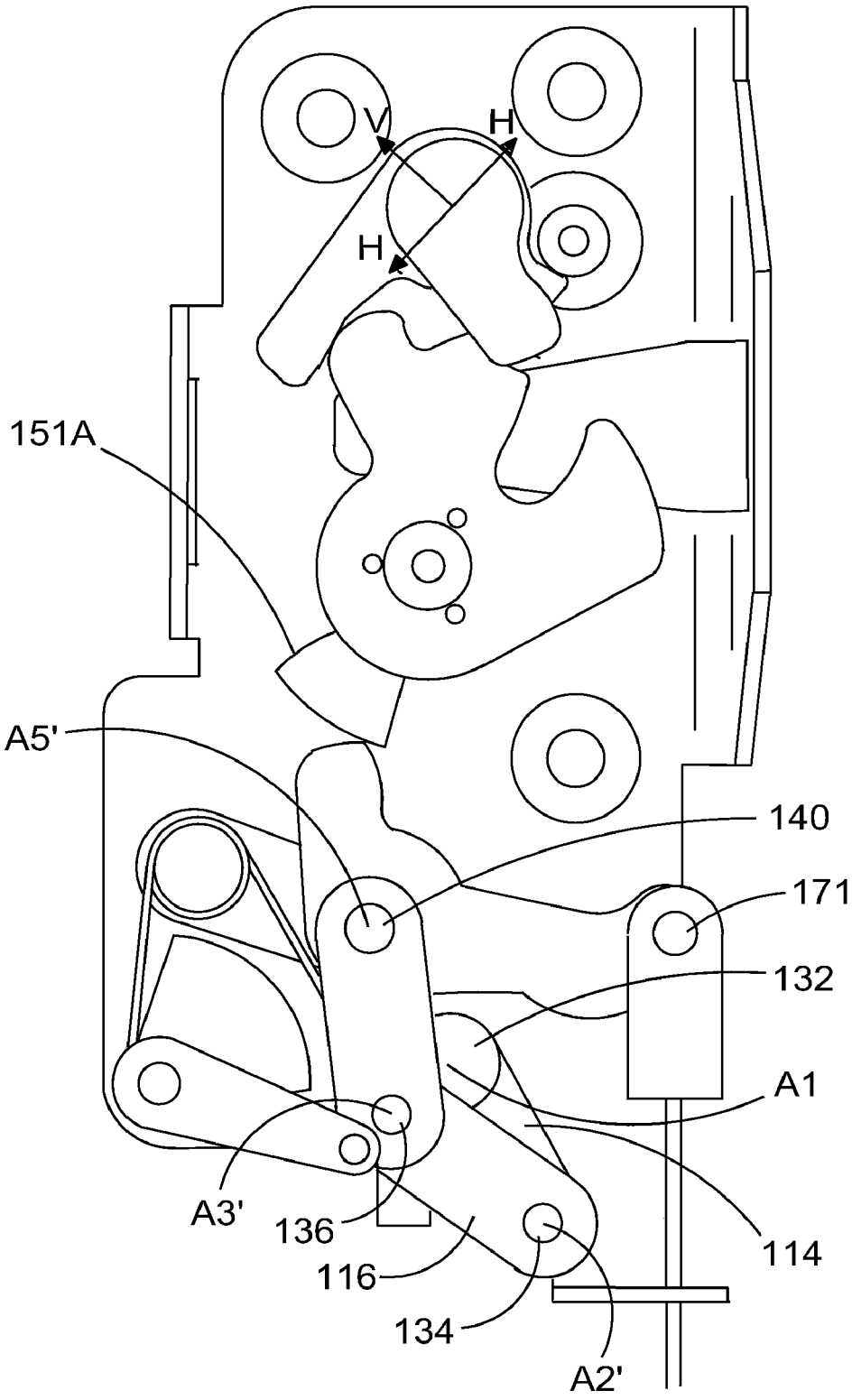

Once the release handle 188 has been released and the power to the power actuator 161 has been stopped, then there is no longer any load on the pin 140, and the spring arm 183 of the torsion spring 180 causes the first link 114 to rotate in a clockwise direction, thereby resetting the first link 114, the second link 116 and the third link 118 to the FIG. 8 position, i.e., to a position where they can then support any load applied to the pin 140 during a subsequent power closure operation.

Because, in this example, the collapsing of the first link 114 and the second link 116 is independent of the operation of the power actuator 161, the door opens quickly. In other words, it is possible to open the door while the power closure mechanism is continuing to go through its full power closure cycle. It is not necessary to wait for the door to be fully closed before it can then be subsequently opened. This is less frustrating to the operator.

FIGS. 9 to 18A show a further embodiment of a latch mechanism 208 according to the present invention in which components which fulfill substantially the same function as those of the latch mechanism 108 are labelled 100 greater. The latch mechanism 208 includes a support mechanism 210 according to the present invention. Axes A1", A2", A3", A4" and A5" of the latch mechanism 208 equate to axes A1', A2', A3', A4' and A5', respectively, of the latch mechanism 108. The distance between the axis A1" and the axis A2" is the same as the distance between the axis A2" and the axis A3".

Note that the torsion spring 280 has its helically wound portion 281 positioned around a pin of the lever 284. This can be contrasted with the helically wound portion 181 of the torsion spring 180 being positioned around the guide pivot pin 179. Otherwise, the torsion spring 280 operates identically to the torsion spring 180.

The first stop 224 fulfills the same function as the first stop 124 of the support mechanism 110 and the first stop 24 of the support mechanism 10. A bent tag of the chassis 212 includes a second stop 226, the equivalent of the second stop 26. In this case, the second stop 226 engages an edge of the link 214. The bent tag also includes a third stop 228, which fulfils the same function as the third stop 28. In this case, the arm 274 of the first link 214 engages the third stop 228.

The principle of operation of the latch mechanism 208 is identical to the principle of operation of the latch mechanism 108. In particular, the various operating modes of the latch mechanism 208 are the same as the various operating modes of the latch mechanism 108 as previously described.

Figure 12:
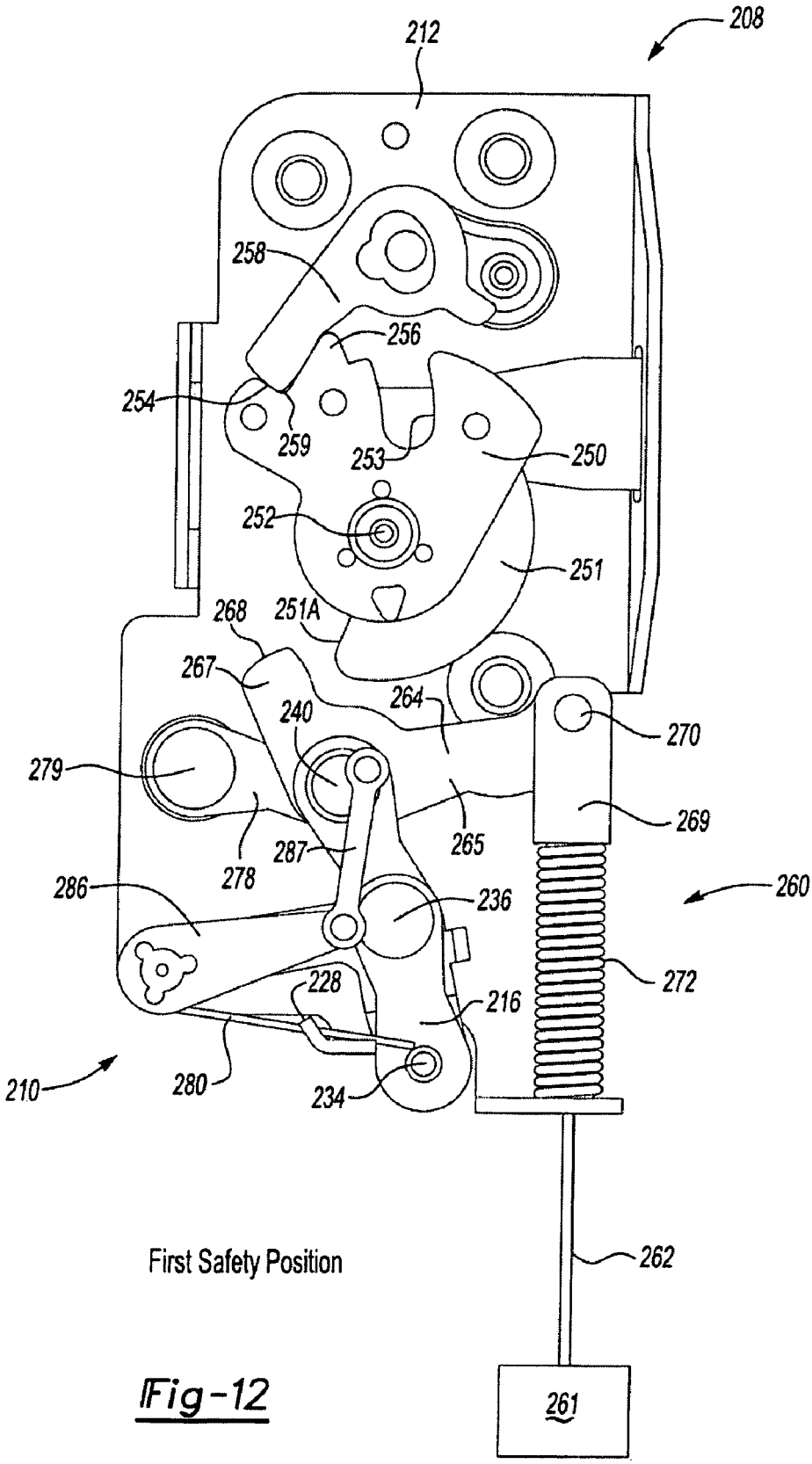
Figure 14:
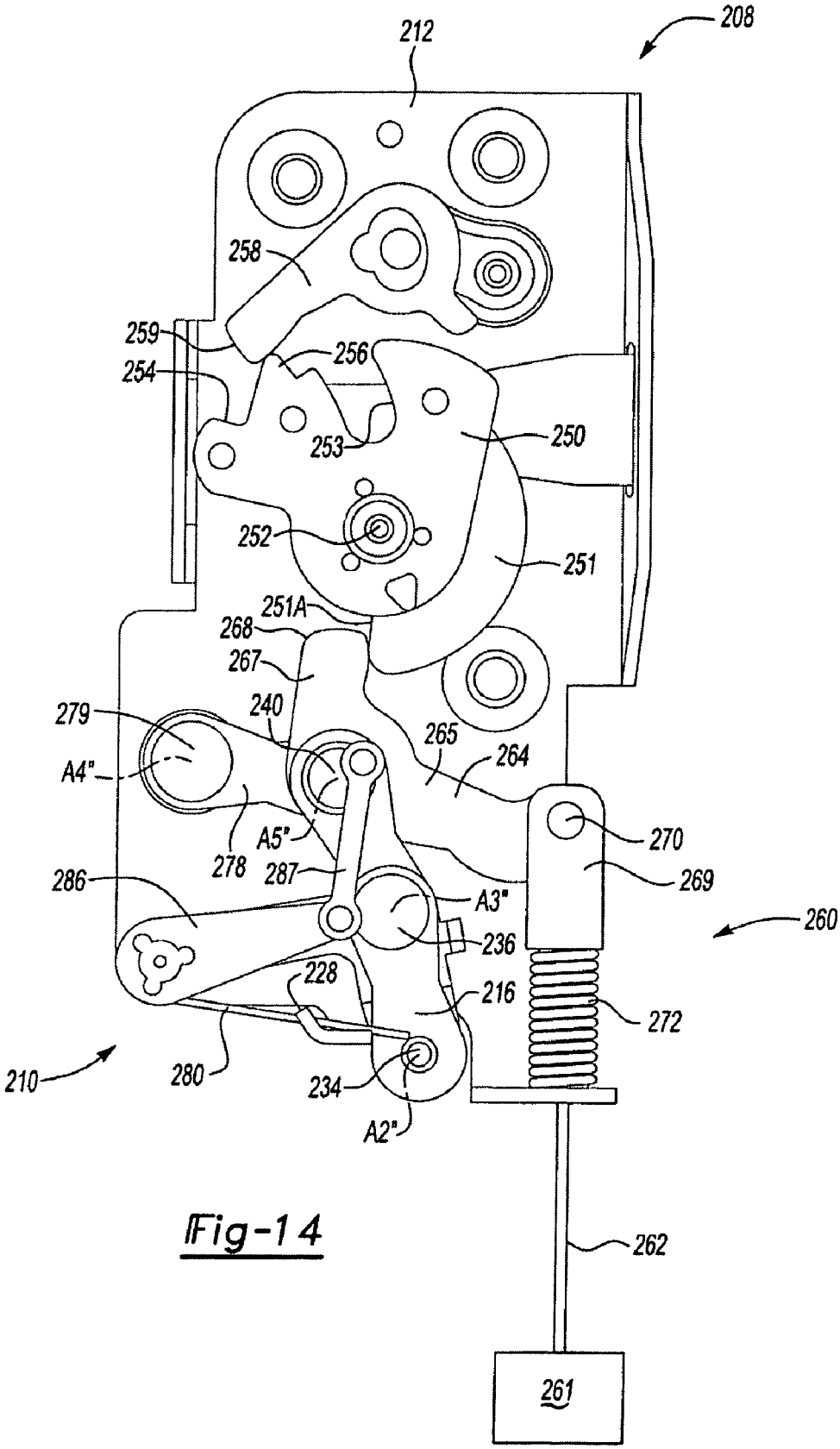
Figure 15:
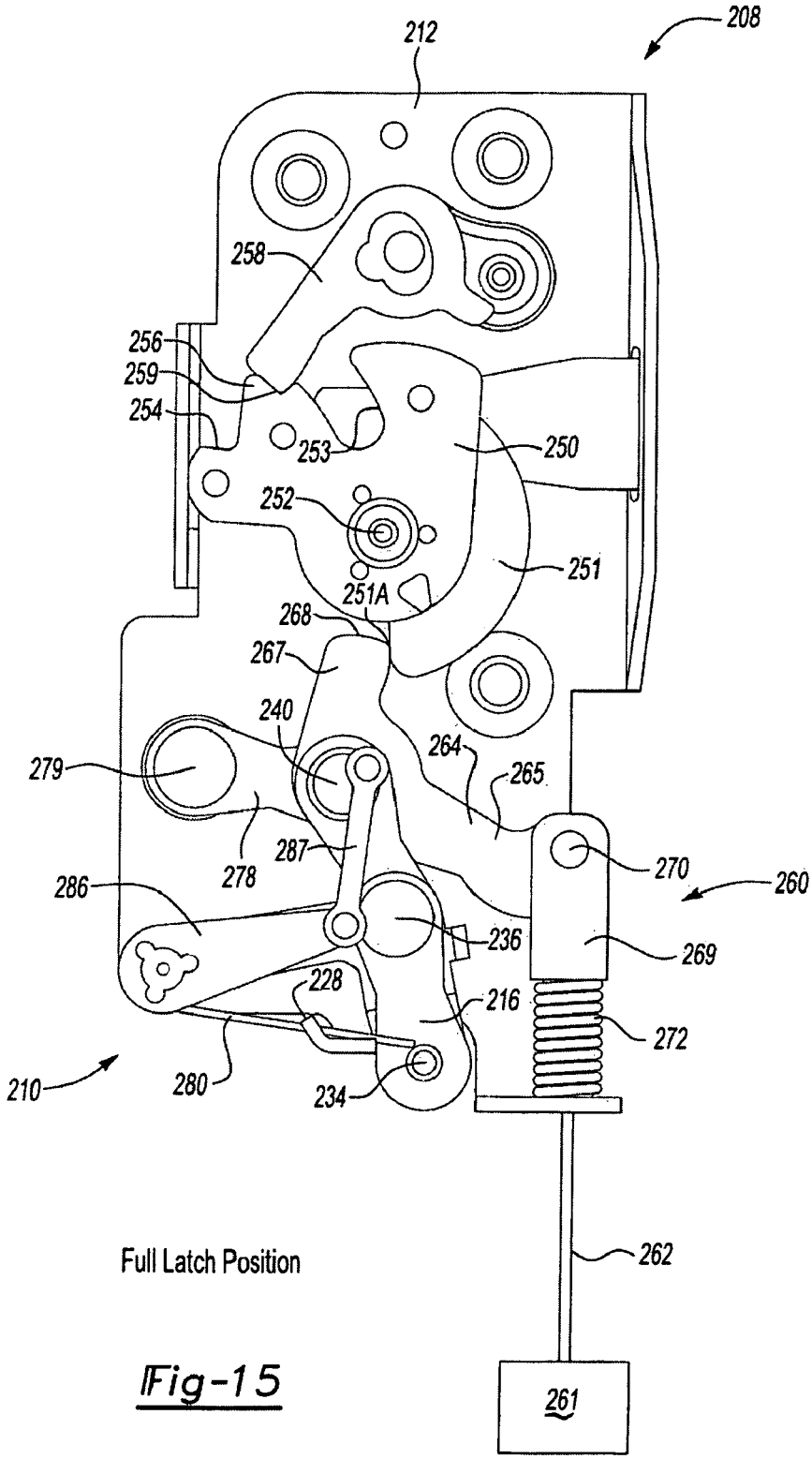
Figure 16:
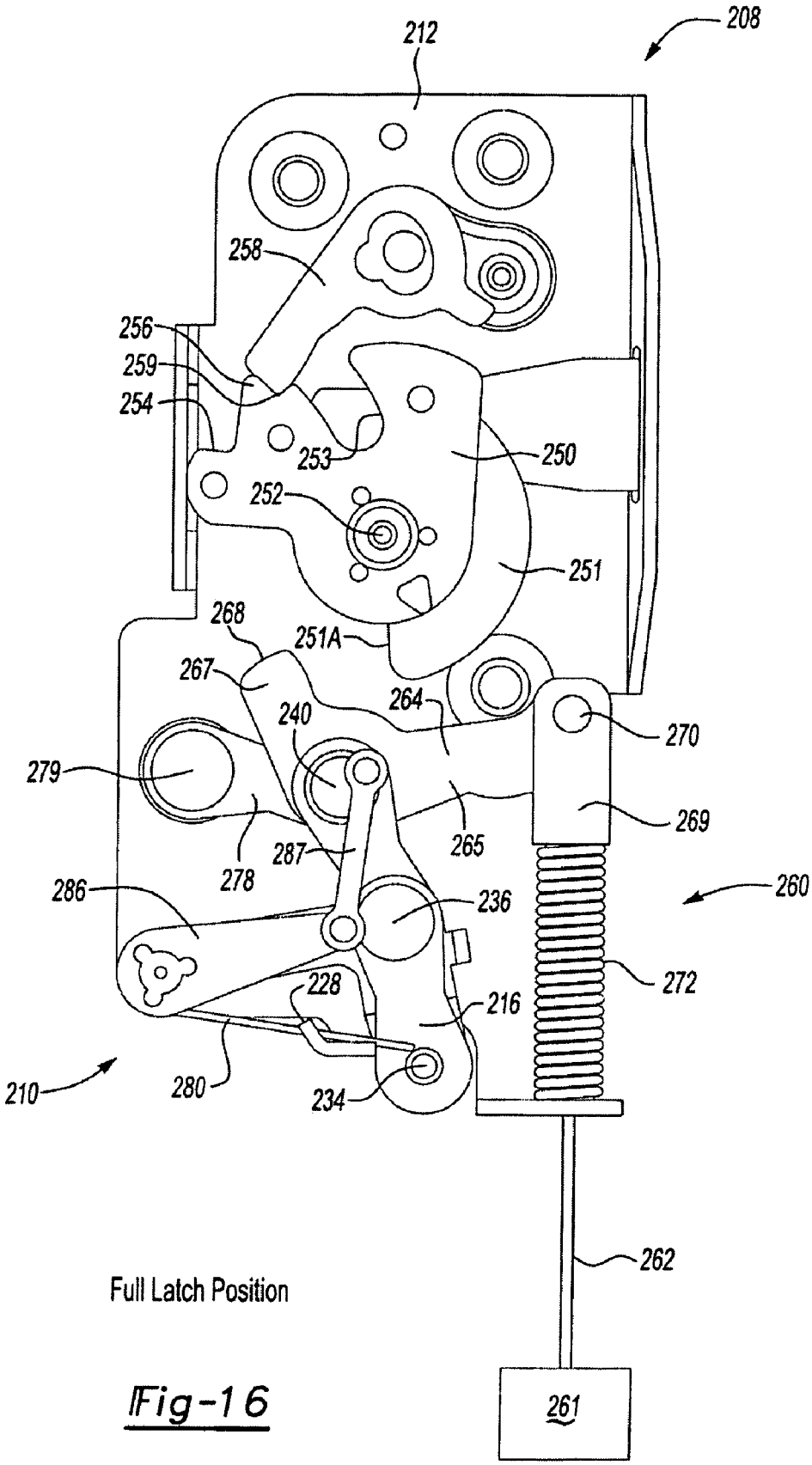
Figure 17:
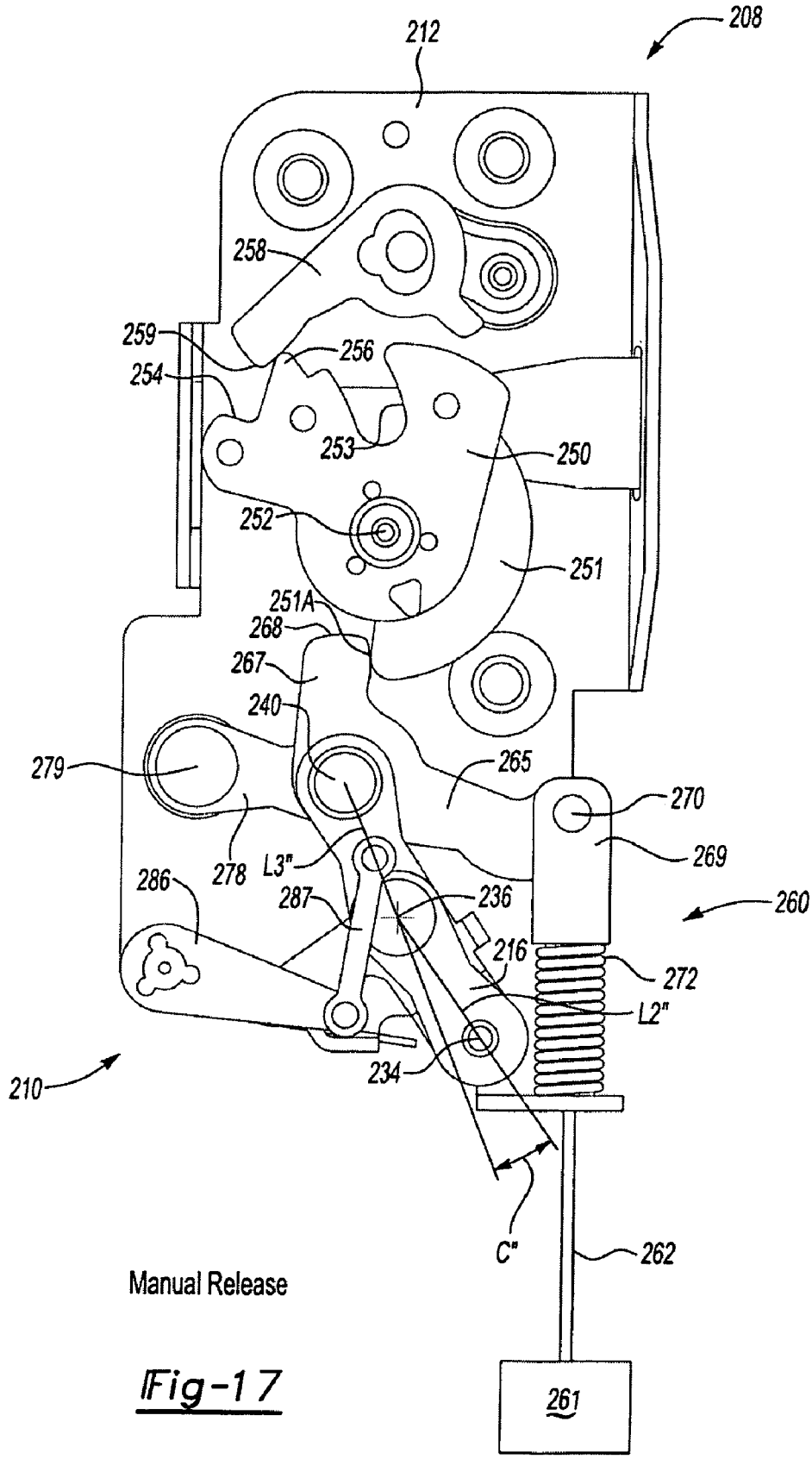

Thus, the latch mechanism 208 has various operating modes as follows: Under normal operating conditions, assume the door is open and the latch mechanism 208 will therefore be in the FIG. 11 position. The vehicle operator will close the door to the first safety position and hence cause the latch to move to the first safety position as shown in FIG. 12. Sensors detect when the latch mechanism 208 is in the first safety position and cause the power actuator 261 to be actuated, which tensions the cable 262 and causes the drive lever 264 to rotate clockwise such that the abutment 268 of the drive lever 264 engages the abutment 251A of the power closure lug 251 (see FIG. 13). Continued operation of the power actuator 261 causes the drive lever 264 to continue to rotate in a clockwise direction (past the FIG. 14 position), resulting in the rotatable claw 250 rotating in a counter-clockwise direction to the fully closed position, as shown in FIG. 15. Sensors detect this fully closed position and power to the power actuator 261 is stopped. The drive lever 264 then returns to its rest position as shown in FIG. 16 and the influence of the compression spring 272.

It will be appreciated that during a power closure operation, a load will have been applied to the third link 216 via the pin 240, tending to compress the third link 218. It would be appreciated that throughout the above mentioned power closure sequence, this load is supported by the support mechanism 210, and in particular the axis A5" of the pin 240 has not moved (i.e., the pin 240 remains in the same position as shown in FIGS. 11, 12, 13, 14, 15 and 16). Note the angle B" between the second link axis L2". In this case, B" is 5 degrees.

However, consider the situation where, part way through the power closure operation, the power actuator 261 jams. Thus, starting at the first safety position shown in FIG. 12, the power actuator 261 is actuated and the drive lever 264 rotates the rotatable claw part way towards the fully closed position. This position is shown in FIG. 14, and it will be appreciated that the pawl tooth 259 has been disengaged from the first safety abutment 254 but has not yet engaged the fully closed abutment 256. For the purposes of this example, it is assumed that the power actuator 261 jams in the FIG. 14 position. It can be seen that the abutment 268 has engaged the abutment 251A, and thus while the components remain in the FIG. 14 position, it is not possible to open the door. This problem is solved by moving the support mechanism 210 such that it can no longer support the load applied to it.

Thus, when in the FIG. 14 position, if the release handle 288 is operated, then this will move the pawl 258 to the disengaged position and will also rotate the lever 284 in a clockwise direction. This clockwise rotation of the lever 284 causes the arm 283 to also rotate in a clockwise direction. In the end of the arm 283 there is provided an elongate slot 283' in which sits the pin 274' of the arm 274 of the first link 214. The arm 274 is caused to move generally downwardly, which results in the first link 214 being rotated counter-clockwise about the first pivot axis A1" to the position shown in FIG. 17. When in this position, the second link 216 and the third link 218 can longer support the load applied to the pin 240 by the drive lever 264 and hence they buckle (collapse) to the position shown in FIGS. 18 and 18A. Note that in the FIG. 13 position, the angle between the second link axis L2" and the third link axis L3" is B" (plus 5 degrees), whereas in the FIG. 17 position this angle has changed to C" (−14 degrees). This collapsing of the second link 216 and the third link 218 allows the pin 240 to rotate in a clockwise direction about the axis A4" since the pin 240 will be guided by the guide link 278. The movement of the pin 240 about the axis A4" causes the abutment 268 to move generally downwardly and hence disengage from the abutment 251A. Once the abutment 268 has disengaged from the abutment 251A, then the rotatable claw 250 is free to rotate in a clockwise direction allowing the door to be opened since, as mentioned above, when the release handle 288 was operated, it rotated the lever 284 disengaged position, thereby ensuring that pawl tooth did not reengage with the first safety abutment 254.

It is also advantageous to operate the support mechanism during operation of the power closure system even when the power closure system operates correctly. This mode of operation is as previously described with reference to the latch mechanism 108.

It will be appreciated that there is a transmission path between the power actuator 261 and the mouth 253 of the rotatable claw 250 that enables the rotatable claw 250 to be driven from the first safety position to the fully closed position, thereby enabling the mouth 253 to hold the associated striker in the closed position. This transmission path includes any gearing (as mentioned above) associated with the power actuator 261, the cable 262, the coupling pin 271, the drive lever 264 and the power closure lug 251 of the rotatable claw 250. As mentioned above, the abutment 268 of the drive lever 264 is selectively engageable and disengageable with the abutment 251A of the power closure lug 251. The power closure lug 251 can be regarded as a "further transmission path component," and the abutment 251A can be regarded as a "drive surface" of the "further transmission path component."

Figure 13:
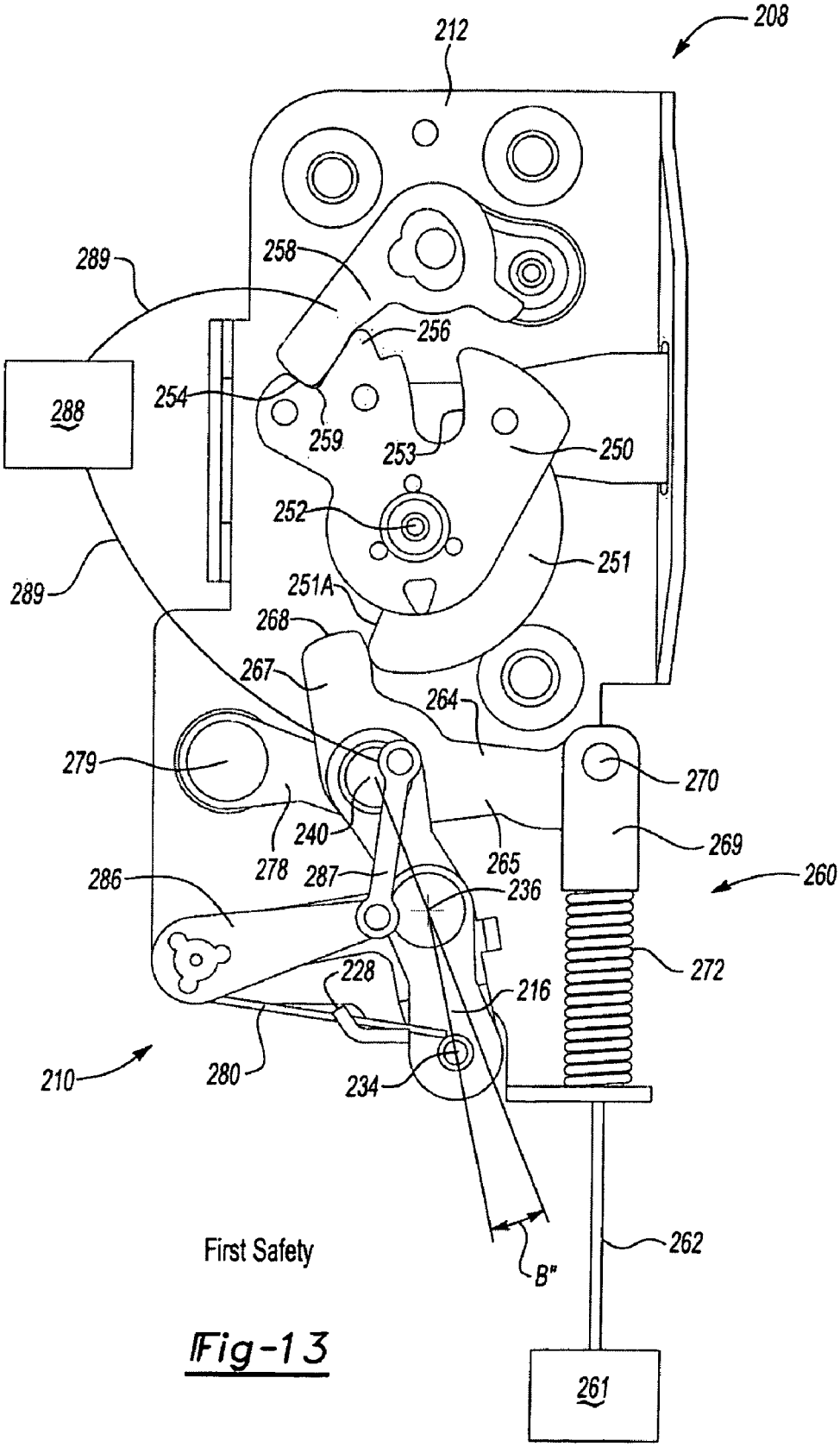
Figure 18:
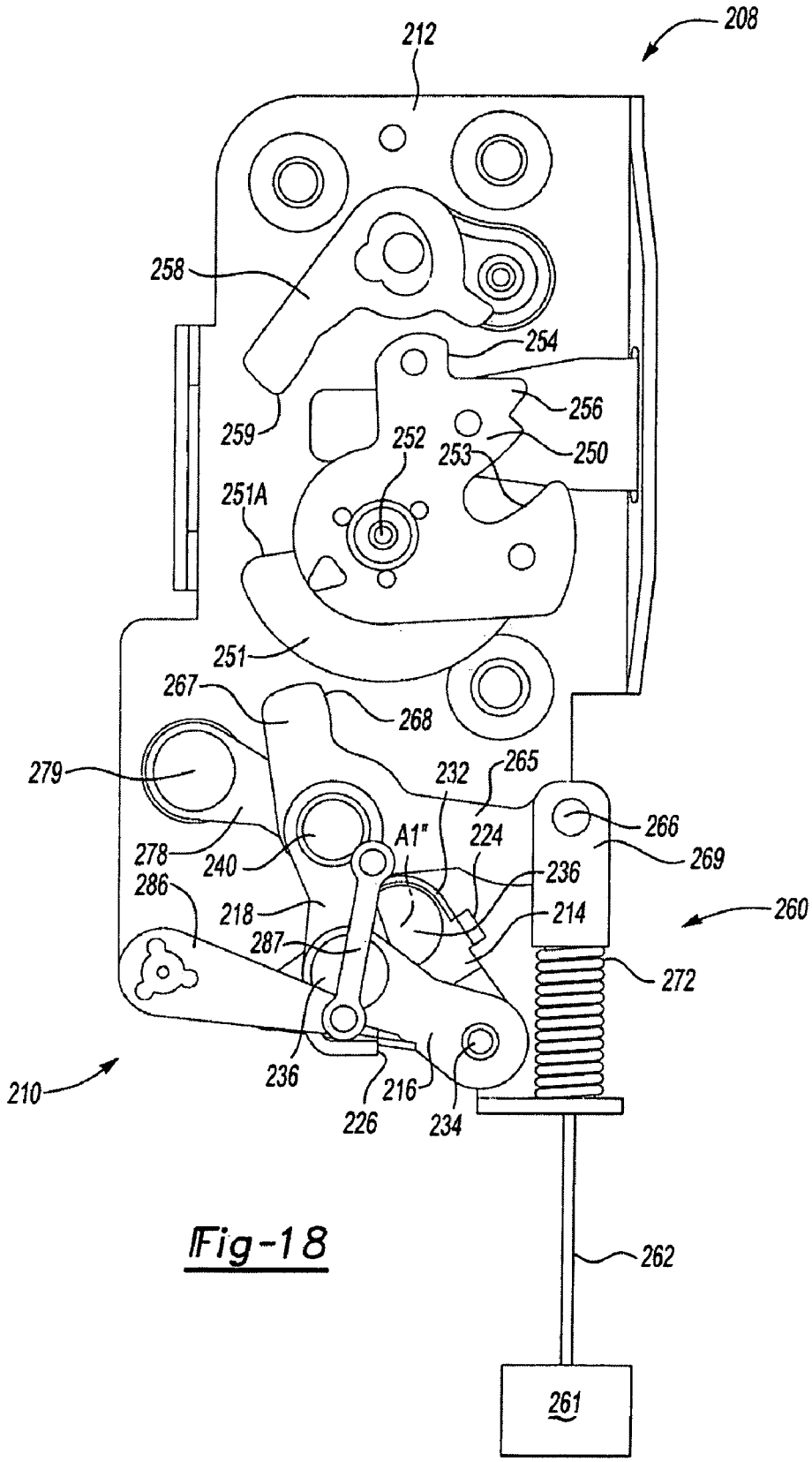
Figure 18A:
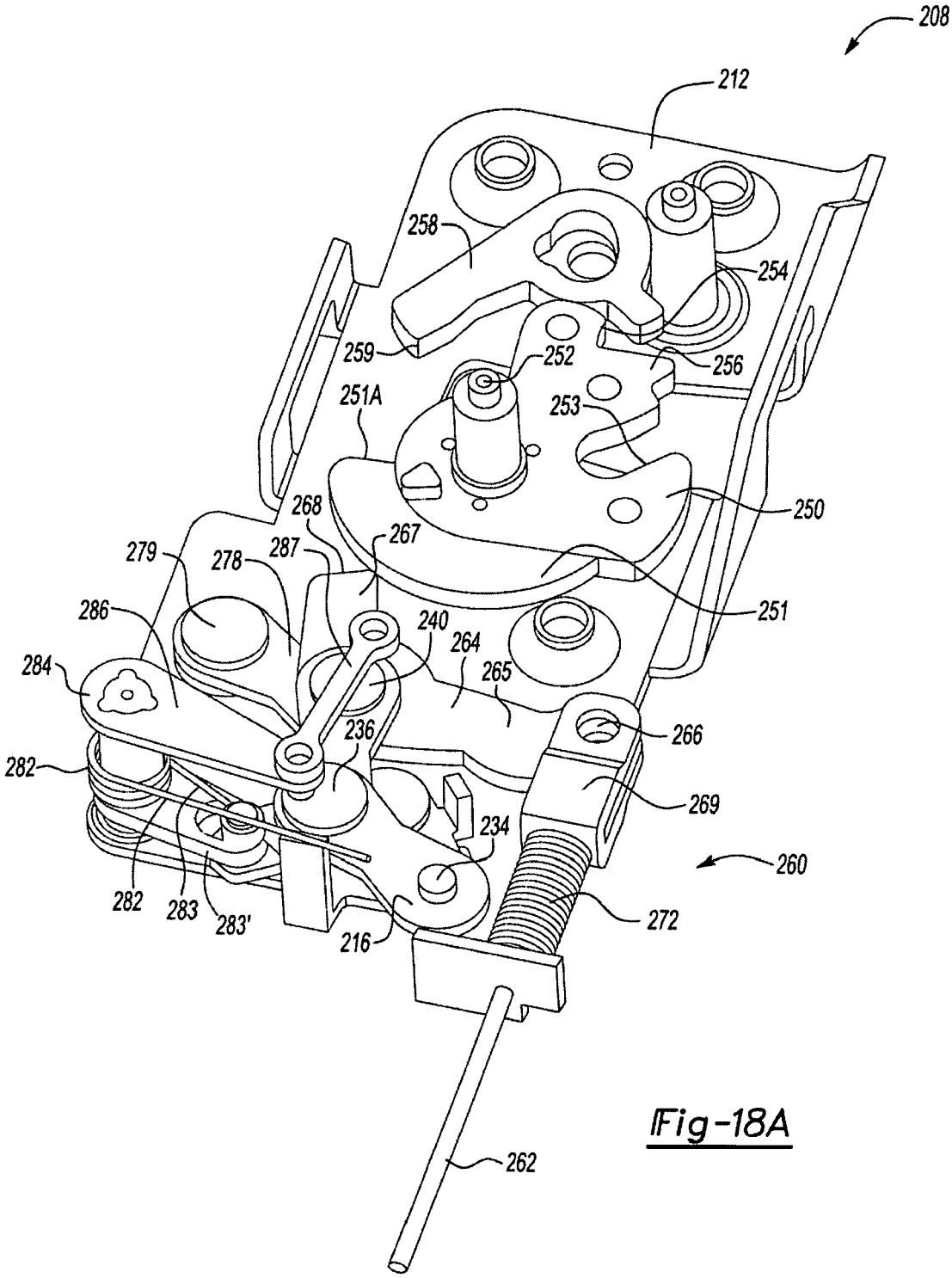
Figure 19:
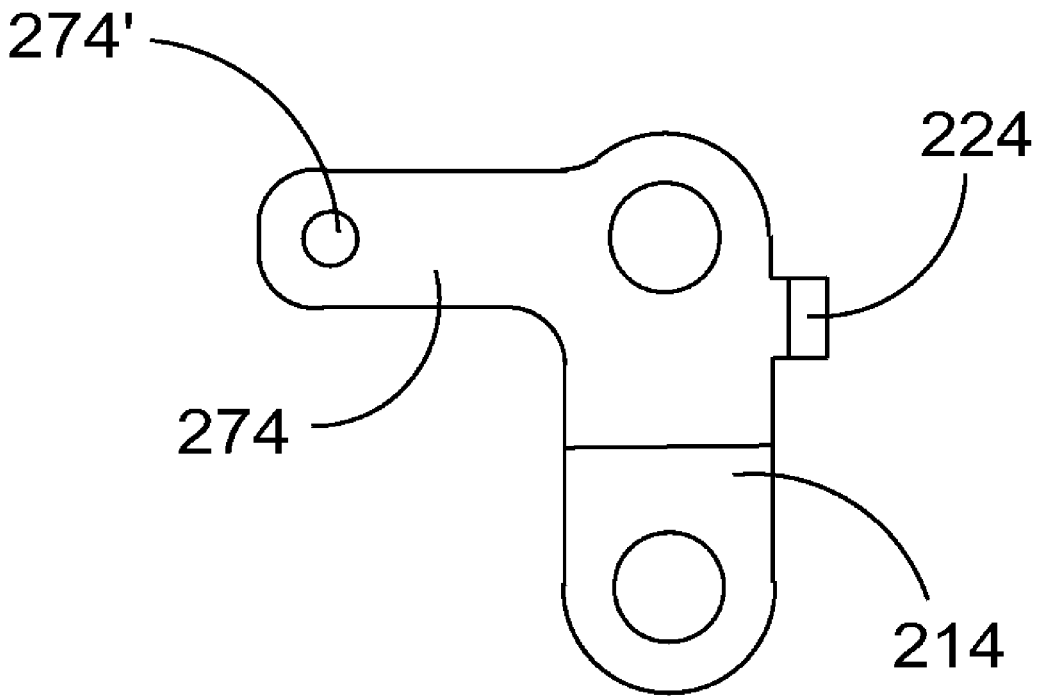
FIG. 19 shows the first link of the latch of FIG. 11 in isolation.

Consideration of FIGS. 13, 15 and 18 shows that the latch mechanism 208 has three distinct positions. The latch mechanism 208 has a first position as shown in FIG. 13 at which the latch bolt is in the first safety position. In this case, the drive lever axis (A5") is in a first drive lever axis position, and the drive lever 264 is engaged with the abutment 251A of the power closure lug 251 (i.e., the "drive surface of a further transmission path component"). The latch mechanism 208 has a second position as shown in FIG. 15 at which the latch bolt is in the closed position. In this case the drive lever axis is in the same first drive lever axis position as shown in FIG. 13, and the drive lever is still engaged with the abutment 251A of the power closure lug 251. The latch mechanism 208 has a third position as shown in FIG. 18 at which the latch bolt is in the open position. In this case, the drive lever axis is now in a second drive lever axis position when compared with the FIGS. 13 and 15 positions. In other words, axis A5" is at a lower position as shown in FIG. 18 when compared with FIGS. 13 and 15. As shown in FIG. 18, the drive lever 264 has disengaged from the abutment 251A of the power closure lug 251 (i.e., disengaged from the "drive surface of the further transmission path component").

It will be appreciated that the latch mechanism 108 has positions equivalent to the first, second and third positions of the latch mechanism 208 as mentioned above. As shown in FIG. 1, the load L is applied directly in line with the third link axis L3. However, in the event that the load is applied at an angle relative to the third link axis L3, then it is possible to resolve the overall load into a component acting in line with the third link axis L3 and a component acting perpendicular to the third link axis L3. The component of a load acting in line with the third link axis L3 will be supported by the support mechanism 110, whereas the component acting perpendicular to the third link axis L3 will be reacted by either the raised rib 21 or the raised rib 22, depending upon which direction this component is acting. Similarly, when considering the load applied to the pin 140 during power closure, the component of that load acting in line with the third link axis L3' will be supported by the support mechanism 110, and the component of that load acting perpendicular to the third link axis L3' will be supported by the guide link 178 being in compression, or tension, depending upon the direction of the component of load. Similarly, any component of load acting perpendicular to the third link axis L3" of the latch mechanism 208 will be supported by the guide link 278 being in compression, or tension, depending upon the direction of the component of load.

As shown in FIG. 1, the second rotational axis A2 lies on the left hand side of the third link axis L3, and the support mechanism 110 is able to support the load L. The second rotational axis A2 is then moved to the right hand side of the third link axis L3 (as shown in FIG. 3), whereupon it can no longer support the load. As shown in FIG. 2, the second rotational axis A2 is in line with the third link axis L3, and in this position the support mechanism 110 can still support the load L. It will be appreciated that there is a position of the second rotational axis A2 between the FIG. 2 and FIG. 3 position where the load L can still just be supported, due to the friction in the various parts of the system. However, as mentioned above, once the second rotational axis A2 reaches the position as shown in FIG. 3, the load is able to overcome the friction within the system and the second link 116 and the third link 118 collapse to the position shown in FIG. 4. The present invention covers support mechanisms where the second rotational axis is positioned at any of the above mentioned positions when the support mechanism 110 can support an appropriate load.

The pawl 158 is pivotally mounted on an eccentric arrangement as described in FIGS. 5 to 9 of international patent application PCT/GB2006/000586 (publication number WO2006/087578). The pawl 258 is pivotally mounted on an improved eccentric arrangement based on FIGS. 5 to 9 of international patent application PCT/GB2006/000586. The improvement is described in the applicant's copending UK patent application entitled "Latch Assembly" and filed the same day as the present application. However, the present invention is equally applicable to mounting of the pawl as shown in the other embodiments shown in WO2006/087578. Furthermore, the present invention is equally applicable to pawls being mounted in the manner shown in EP0978609, U.S. Pat. No. 5,188,406, 4,988,135, DE10214691, U.S. Pat. No. 3,386,761 and US2004/0227358. In short, the present invention is applicable to all latches, however their associated pawls are mounted and controlled.

As shown in FIG. 5, the latch bolt (the rotatable claw 150) includes two abutments (the first safety abutment 154 and the closed abutment 156), which are engaged by a single pawl tooth 159 to provide for the closed position and first safety position. In further embodiments, a latch bolt may be provided with a single abutment, and the pawl may be provided with two abutments (a first safety abutment and a closed abutment) to provide for the closed position and the first safety position of the latch mechanism 108.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A latch mechanism moveable between a first latch position, a second latch position and a third latch position, the latch mechanism comprising:

a latch bolt moveable between an open position, a first safety position and a closed position; and a power closure system operable to move the latch bolt from the first safety position to the closed position, the power closure system having a transmission path including a drive lever rotatable about a drive lever axis and being engageable with a drive surface of a further transmission path component, the transmission path being operable to connect a power actuator to the latch bolt, wherein when the latch mechanism is in the first latch position the latch bolt is in the first safety position, the drive lever axis is in a first drive lever axis position, and the drive lever is engaged with the drive surface of the further transmission path component, wherein when the latch mechanism is in the second latch position the latch bolt is in the closed position, the drive lever axis is in the first drive lever axis position, and the drive lever is engaged with the drive surface of the further transmission path component, and wherein when the latch mechanism is in the third latch position the latch bolt is in the open position, the drive lever axis is in a second drive lever axis position, and the drive lever is disengaged from the drive surface of the further transmission path component, and wherein the latch mechanism is stationary in the open position, the first safety position and the closed position;

a support mechanism to hold the drive lever axis in the first drive lever axis position when the latch mechanism is in the first latch position and in the second latch position, and the support mechanism allows the drive lever axis to move to the second drive lever axis position when the latch mechanism moves to the third latch position, wherein the latch mechanism has a chassis, and the support mechanism includes:

a first link pivotally attached to the chassis about a first rotational axis, a second link pivotally attached to the first link about a second rotational axis, and a third link pivotally attached to the second link about a third rotational axis, the third link having a load application point defined by the drive lever axis and being remote from the third rotational axis, wherein the first rotational axis and the second rotational axis define a first link axis, the second rotational axis and the third rotational axis define a second link axis, and the third rotational axis and the load application point define a third link axis, wherein the support mechanism has a first support mechanism position when the drive lever axis is in the first drive lever axis position for supporting a load applied at the load application point in a direction of the third link axis, and the first link axis and the second link axis are generally parallel and the first rotational axis and the third rotational axis are generally in line, and the support mechanism has a second support mechanism position when the drive lever axis is in the second drive lever axis position and the third rotational axis is generally remote from the first rotational axis, wherein a portion of the third link remote from the third rotational axis is constrained to move along a predetermined path between the first latch position and the second latch position, and wherein the predetemined path is an arcuate path, and a guide link has a first guide link portion pivotally mounted on the chassis and a second guide link portion pivotally mounted at the portion of the third link via a guide pivot having a guide pivot axis to guide the portion of the third link in the arcuate path.

2. The latch mechanism as defined in claim 1 including a first stop to limit movement of the third rotational axis laterally relative to at least one of the second link axis and the third link axis.

3. The latch mechanism as defined in claim 2 wherein the first stop is provided on one of the chassis and the first link.

4. The latch mechanism as defined in claim 2 wherein the support mechanism includes a second stop to limit movement of the second rotational axis laterally relative to at least one of the second link axis and first link axis.

5. The latch mechanism as defined in claim 4 wherein the second stop is provided on the chassis.

6. The latch mechanism as defined in claim 2 wherein the support mechanism includes a second stop to limit movement of the second rotational axis laterally relative to at least one of the second link axis and the first link axis, the first stop limits movement of the third rotational axis laterally in a first direction, and the second stop limits movement of the second rotational axis in a second direction generally opposite to the first direction.

7. The latch mechanism as defined in claim 4 including a third stop to limit movement of the second rotational axis laterally relative to at least one of the second link axis and the first link axis.

8. The latch mechanism as defined in claim 7 wherein the third stop is provided on the chassis.

9. The latch mechanism as defined in claim 1 wherein the portion is proximate the load application point.

10. The latch mechanism as defined in claim 1 wherein the predetermined path is one of a straight line and an arcuate path.

11. The latch mechanism as defined in claim 1 wherein the guide pivot axis is coincident with the drive lever axis.

12. The latch mechanism as defined in claim 1 wherein the drive surface of the further transmission path component is a drive surface of a lug of the latch bolt.

13. The latch mechanism as defined in claim 1 wherein the latch bolt is rotatably mounted on the chassis.

* * * * *